US011759018B2

(12) United States Patent
Horn et al.

(10) Patent No.: US 11,759,018 B2
(45) Date of Patent: Sep. 19, 2023

(54) SPRING CUSHIONED CHAIR

(71) Applicants: Vincent Horn, San Francisco, CA (US); Jane Ellen Bube, Seattle, WA (US)

(72) Inventors: Vincent Horn, San Francisco, CA (US); Jane Ellen Bube, Seattle, WA (US)

( * ) Notice: Subject to any disclaimer, the term of this patent is extended or adjusted under 35 U.S.C. 154(b) by 0 days.

(21) Appl. No.: 17/325,054

(22) Filed: May 19, 2021

(65) Prior Publication Data

US 2022/0369813 A1 Nov. 24, 2022

(51) Int. Cl.
*A47C 7/34* (2006.01)
*A47C 5/04* (2006.01)

(52) U.S. Cl.
CPC ..... *A47C 7/347* (2013.01); *A47C 5/04* (2013.01)

(58) Field of Classification Search
CPC ..... A47C 23/002; A47C 7/144
USPC ..... 297/451.4, 451.8, 451.12, 446.1, 446.2
See application file for complete search history.

(56) References Cited

U.S. PATENT DOCUMENTS 4,965,898 A * 10/1990 So ..... A47C 23/002 5/652
6,217,121 B1 * 4/2001 Mollet ..... A47C 7/144 297/452.21
D794,344 S * 8/2017 MacAllen ..... D6/335
10,136,730 B2 * 11/2018 Kim ..... A47C 3/04
10,194,748 B1 * 2/2019 Baker ..... A47C 1/00

FOREIGN PATENT DOCUMENTS

EP 2298135 A1 * 3/2011 ..... A47C 23/002

* cited by examiner

*Primary Examiner* — Sarah B McPartlin
(74) *Attorney, Agent, or Firm* — Cynthia S. Lamon; Lamon Patent Services

(57) ABSTRACT

A chair has a metal base, a matrix of metal tubes having a common outside and an inside diameter, welded orthogonal to the metal base, extending vertically, and a matrix of posts matching the matrix of metal tubes, the posts bored for a portion of a length of each post, with each post engaged over one of the metal tubes. The chair is characterized in that one row of posts along one edge of the metal base comprises posts of a height greater than other posts, and forms a backrest for the chair, and in that the remaining matrix of posts, of a lesser height than the posts forming the backrest, are of a common height, and form a seat surface for the chair.

14 Claims, 6 Drawing Sheets

SPRING CUSHIONED CHAIR

BACKGROUND OF THE INVENTION

1. Field of the Invention

The present invention is in the technical area of furniture and pertains more particularly to a chair constructed of telescoping metal and wooden elements, with spring integration.

2. Description of Related Art

Chairs of many sorts are known in the art, including upholstered models and simple kitchen and dining room models. There are many known ways of cushioning seats for chairs as well. The inventor believes, however, that there is room in the art for new ways of supporting and cushioning chairs in ways that provide a unique appearance as well as new functionality. The inventor therefore teaches a novel new way to make a chair with a matrix of spring-supported vertical posts.

BRIEF SUMMARY OF THE INVENTION

In one embodiment of the invention a chair is provided, comprising a metal base, a matrix of metal tubes having a common outside and an inside diameter, welded orthogonal to the metal base, extending vertically, and a matrix of posts matching the matrix of metal tubes, the posts bored for a portion of a length of each post, with each post engaged over one of the metal tubes. The chair is characterized in that one row of posts along one edge of the metal base comprises posts of a height greater than other posts, and forms a backrest for the chair, and in that the remaining matrix of posts, of a lesser height than the posts forming the backrest, are of a common height, and form a seat surface for the chair.

In one embodiment the posts are round in cross section. Also, in one embodiment a portion of the posts forming the seat surface of the chair are compound posts having an upper portion engaging the outside diameter of the tubes, the upper portion supported on a compression spring such that the upper portion of posts in that portion provide a reliant surface for a subject seated on the chair. In one embodiment the post portions supported by compression springs are all in the matrix in positions other than along any one of the four edges of the matrix. And in one embodiment the metal tubes welded to the base for the posts supported by compression springs have a cylindrical insert in the inside of the tube supporting the compression spring.

In one embodiment the metal base comprises as assembly of metal strips, comprising first metal strips parallel and equally spaced apart, and second metal strips laid at a right angle on the first metal strips, parallel and equally spaced apart, and wherein the metal tubes are welded in rows onto the second metal strips. Also, in one embodiment the chair further comprises cap structures over the upper ends of the posts forming the seat surface of the chair, the cap structures configured to fit over the posts removably and to provide a cushion surface on an upper end of the posts. In one embodiment the cap structures are fabric structures comprising a skirt and a cushion.

In an alternative embodiment of the invention the posts are square in cross section. In one embodiment with square posts a portion of the posts forming the seat surface of the chair are compound posts having an upper portion engaging the outside diameter of the tubes, the upper portion supported on a compression spring such that the upper portion of posts in that portion provide a reliant surface for a subject seated on the chair. In one embodiment the upper portions of the posts are keyed to the lower portions and the lower portions are keyed to the metal base, such that the posts are constrained from rotating on the metal tubes and from rotating relative to one another.

In one embodiment the post portions supported by compression springs are all in the matrix in positions other than along any one of the four edges of the matrix. Also, in one embodiment the metal tubes welded to the base for the posts supported by compression springs have a cylindrical insert in the inside of the tube supporting the compression spring. In one embodiment the metal base comprises as assembly of metal strips, comprising first metal strips parallel and equally spaced apart, and second metal strips laid at a right angle on the first metal strips, parallel and equally spaced apart, and wherein the metal tubes are welded in rows onto the second metal strips. In one embodiment the chair further comprises cap structures over the upper ends of the posts forming the seat surface of the chair, the cap structures configured to fit over the posts removably and to provide a cushion surface on an upper end of the posts. And in one embodiment the cap structures are fabric structures comprising a skirt and a cushion.

DETAILED DESCRIPTION OF THE INVENTION

Figure 1A:
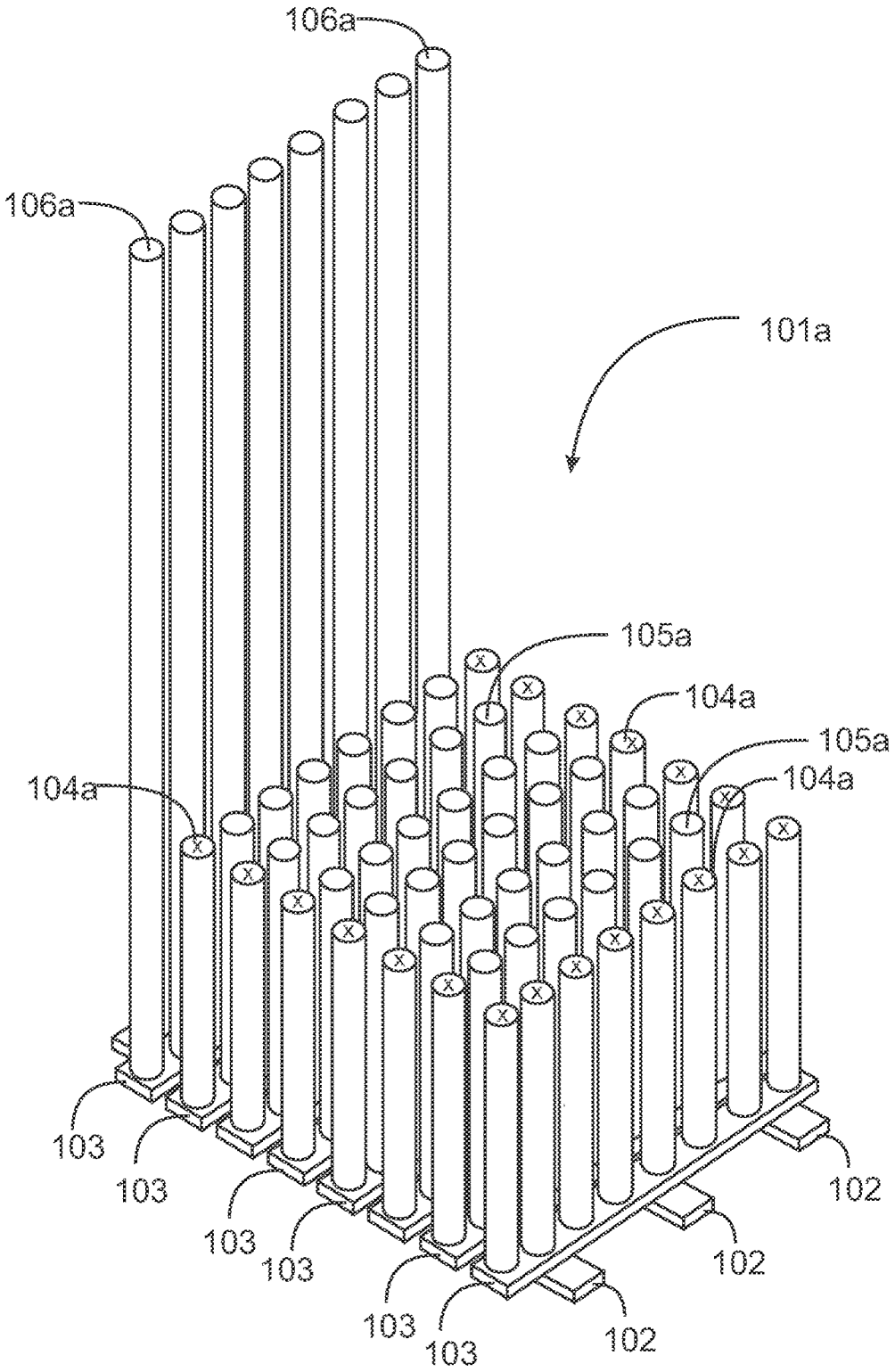
FIG. 1A is a perspective view of a chair in an embodiment of the invention.

FIG. 1A is a perspective view of a chair 101*a* in an embodiment of the invention. Chair 101*a* is built upon a metal base comprising crossed metal plates 102 and 103 that are welded together in one embodiment. A chair back is provided by a row, in this example, of eight upright round wooden posts 106*a*, that are assembled to the metal base in a manner described in enabling detail below.

A rectangular matrix of round wooden posts 104*a* and 105*a* form a seat for chair 101*a*. In this example there are twenty posts 104*a* that form a rectangular boundary along each outer edge and the front of the seat area of the chair. Posts 104*a* that form this boundary are each marked with an x on the upper surface. Thirty-six posts 105*a* in a square array within the boundary of posts 104*a* form a spring-supported seat for the chair. In this example posts 104*a* are not spring supported. The nature of the spring support for individual posts 105*a* is described below in enabling detail. In one embodiment posts 104*a* and 105*a* are topped with cushions that are not shown in FIG. 1*a* but are illustrated in another figure and described in detail below.

Figure 1B:
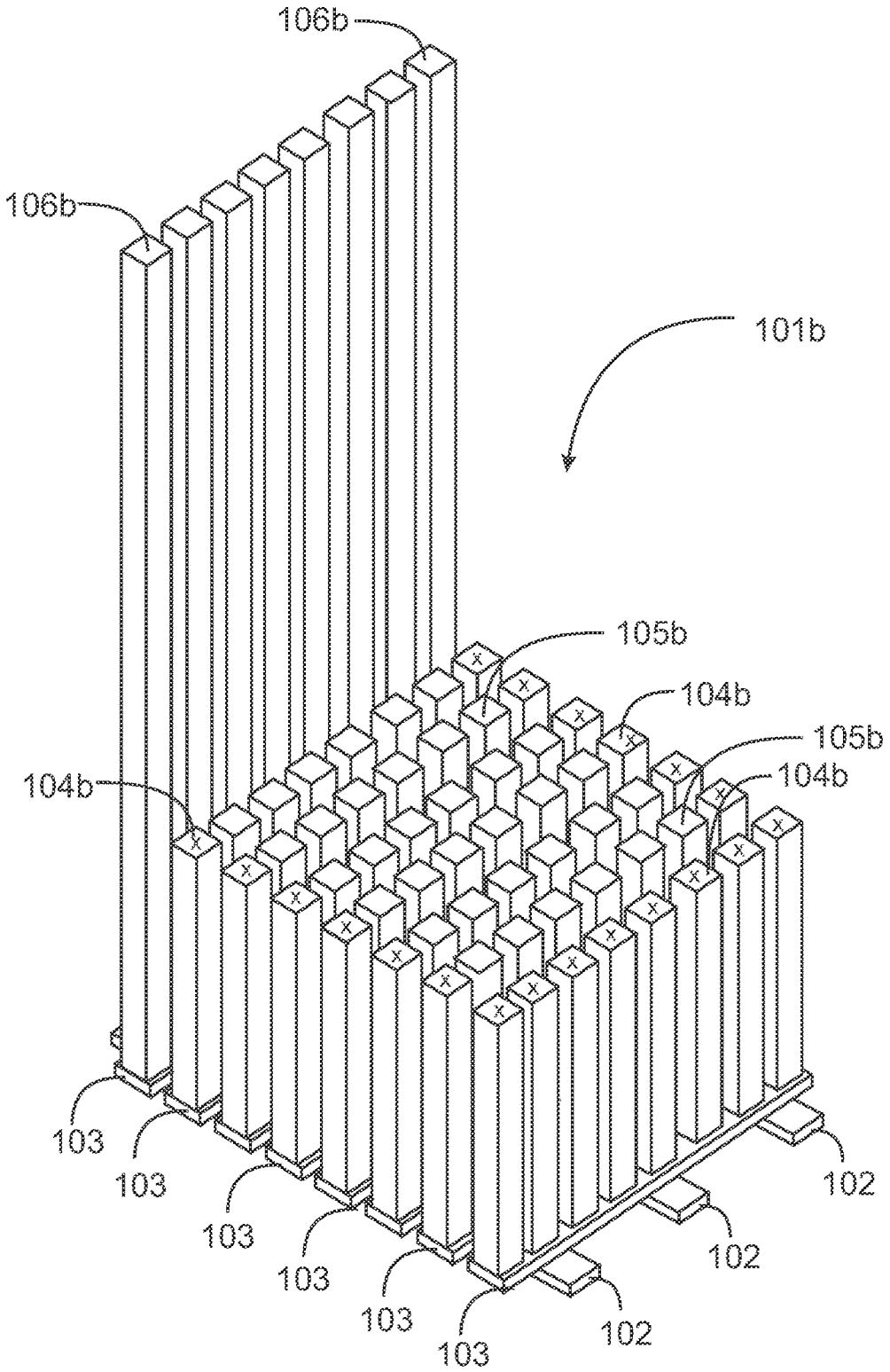
FIG. 1B is a perspective view of a chair in another embodiment of the invention.

FIG. 1B is a perspective view of a chair 101*b* in an embodiment of the invention. Chair 101*b* is built upon a metal base comprising crossed metal plates 102 and 103 that are welded together in one embodiment. A chair back is provided by a row, in this example, of eight upright square wooden posts 106*b*, that are assembled to the metal base in a manner described in enabling detail below.

A rectangular matrix of square wooden posts 104*b* and 105*b* form a seat for chair 101*b*. In this example there are twenty posts 104*b* that form a rectangular boundary along each outer edge and the front of the seat area of the chair. Posts 104*b* that form this boundary are each marked with an x on the upper surface. Thirty-six posts 105*b* in a square array within the boundary of posts 104*b* form a spring-supported seat for the chair. In this example posts 104*b* are not spring supported. The nature of the spring support for individual posts 105*b* is described below in enabling detail. In one embodiment posts 104*b* and 105*b* are topped with cushions that are not shown in FIG. 1B but are illustrated in another figure and described in detail below.

FIGS. 1A and 1B provide enabling details for the circumstance that the posts are either round or square. These shapes are not limiting to the invention, as the cross-section shape of posts for the chair in different embodiments may be hexagonal or other shapes, and not all posts must have the same cross-sectional shape.

Figure 2:
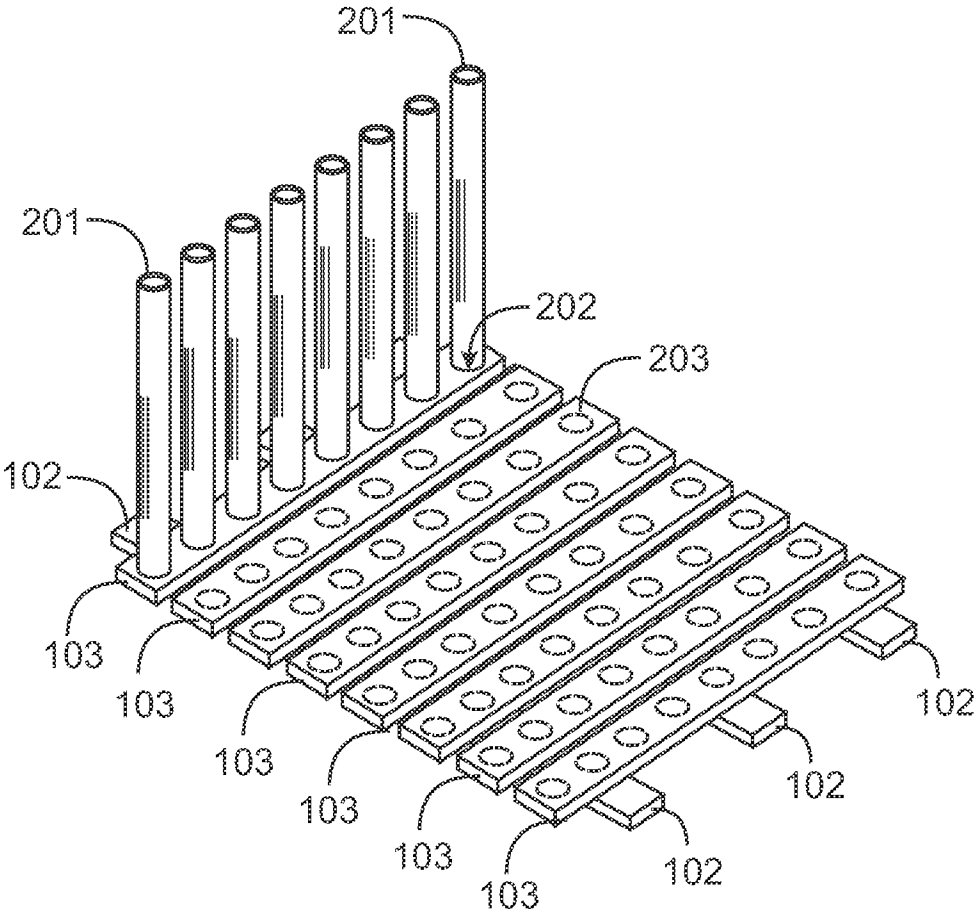
FIG. 2 is a perspective view of a partial base of the chair of FIG. 1.

FIG. 2 is a perspective view of a partial base of the chairs of FIGS. 1A and 1B. In the view of FIG. 2 a metal base is illustrated formed by three metal strips 102 and eight metal strips 103 that are laid equally spaced across the strips 102. Strips 102 and 103 in this example have a common width and thickness, but this may differ in other embodiments. Strips 102 and 103 are welded together in this example to form a secure base resting on strips 102.

Eight metal tubes 201 are shown welded at base 202 for each tube to one outside strip 103. In one embodiment these tubes may be Electric Metallic Tube (EMT) conduit but may be other sorts of metal tubes in other embodiments. Weldable tubes are preferred. In this example tubes 201 are equally spaced along strip 103. These tubes along the rearmost strip 103 form a support structure for the back of the chair comprising posts 106*a* or 106*b*. The height of strips 201 may vary in different embodiments, but in this example the height is about one-fourth of the height of posts 106*a* or 106*b*. Metal tubes like tubes 201 are also used to support posts 104*a* and 104*b* and 105*a* and 105*b* in embodiments of the invention. Strips 103, other than the strip for the back of the chair, are annotated with dotted circles to show where tubes for posts may be welded to the strips 103. The base and the assembly of posts 201 is the same whether round or square posts may be used.

Figure 3:
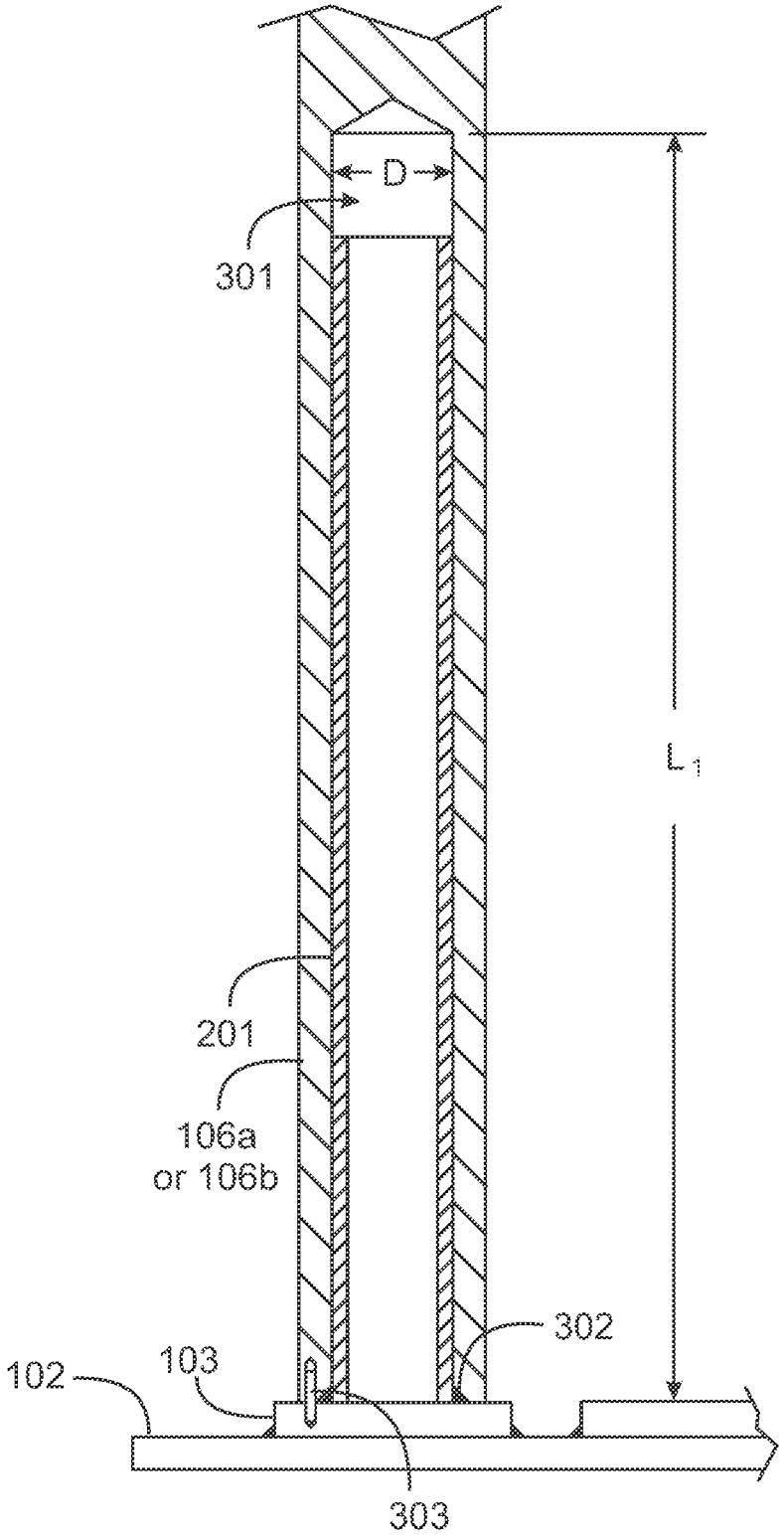
FIG. 3 is a partial cross section of one post and tube in an embodiment of the invention.

As described above, the back row of posts and tubes is to form a backrest for the chair. FIG. 3 is a partial cross-section view of one post 106*a* or 106*b* in the back row fitted over a tube 201, with details to describe how posts 106*a* or 106*b* are supported by the tube, how the post is secured on the tube and how the post is oriented rotationally and kept in orientation. Post 106*a* or 106*b* has a bore 301 of diameter D from one end for a length L that is somewhat longer than the height of tube 201. Tube 201 is welded as shown at 302 to the top surface of metal plate 103, which is welded to lower plate 102, as seen in FIG. 2. Post 106*a* or 106*b* is then fitted down over tube 201. Bore 301 is chamfered on the lower end of the post to clear the weld at 302.

It is desired when using square posts that post 106*b* be secured once fitted over tube 201 so it doesn't rotate around the tube and cannot easily be pulled upward off the tube. In this example at least one set of small holes is drilled both in the top of plate 103 and into the bottom surface of post 106*b*, such that a pin 303 may be pressed into plate 103 and post 106*b* may also be pressed downward to engage the pin. One pin is shown, but more than one may be used. This is one way the posts 106*b* may be positioned and secured. There are other ways that this function may be provided.

Referring back to FIGS. 1A and 1B all posts 106*a* or 106*b*, eight in this example, are fitted and secured over tubes 201 as shown and described with reference to FIG. 3, except that pin 303 is not requires in the embodiment with round posts. Further, posts 104*a* or 104*b*, twenty in this example, that form an outer border of the seat, each marked with an x in FIG. 1, are assembled to shorter tubes welded to cross plates 103 in positions indicated by dotted circles 203 at the ends of cross plates 103 and across the frontmost cross plate. The length of posts 104*a* or 104*b* is substantially shorter than the length of posts 106*a* or 106*b*, as the top of these posts are at a height for a seat of the chair. Consequently, the depth of the bore for posts 104*a* or 104*b* is shorter as well. Other than these differences, posts 104*a* and 104*b* are positioned and secured in the same way as explained above for posts 106*a* or 106*b*.

Figure 4:
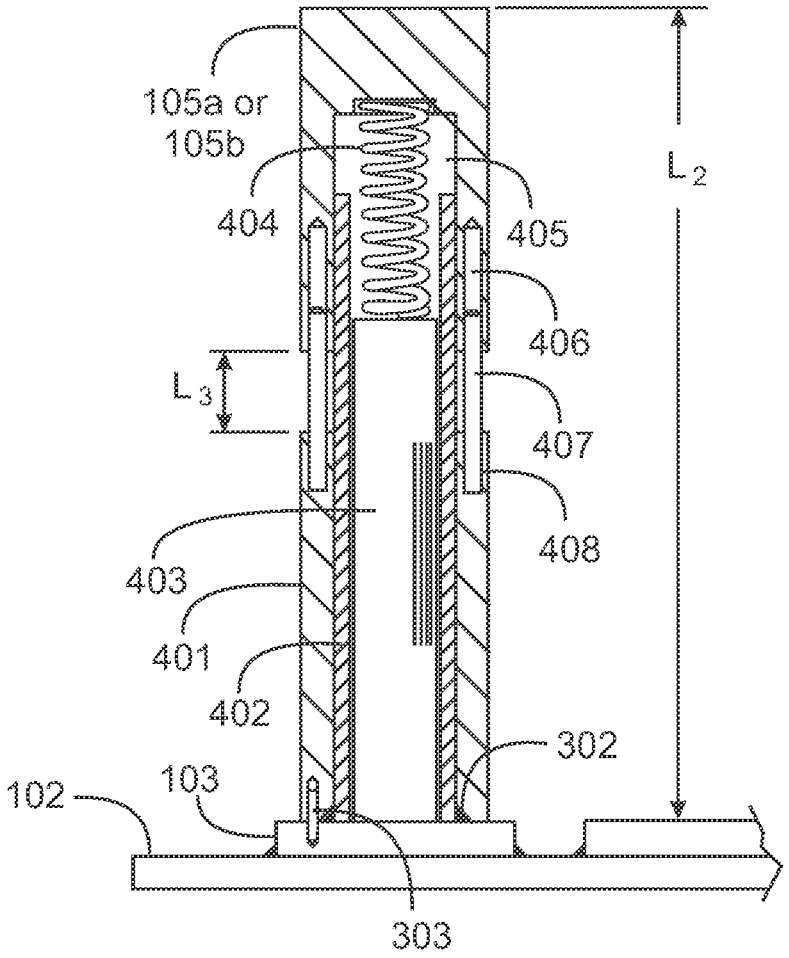
FIG. 4 is a partial cross section illustrating how each post may be mounted and secured.

Thirty-six posts 105*a* or 105*b* are spring-supported posts that form a resilient seat area for the chair. FIG. 4 is a partial cross section illustrating how each post 105*a* or 105*b* may be mounted and secured. In FIG. 4 a metal tube 402 is shown welded to a cross metal plate 103 at a position on the plate directly beneath a post 105*a* or 105*b*. Tube 402 is the same diameter and wall thickness as tubes 201 in FIG. 2 but is of a length to accommodate the elements and assembly of FIG. 4 to support the posts 105*a* or 105*b* at a height L2 for a chair seat. The heights and dimensions may vary for different chairs. A round plug 403 of a diameter to be a slip fit with the inside diameter of tube 402 is placed into tube 402 and served as a support seat for a lower end of a compression spring 404 which is placed into tube 402 and seats on plug 403.

Post 105*a* or 105*b* is of a height L4 which is considerably shorter than posts 106*a* or 106*b*. Post 105*a* or 105*b* is bored from the lower end to provide an upper seat for spring 404 and may have a counterbore as shown to capture the upper end of the spring. The bore has a diameter that provides a slip fit over the outer diameter of tube 402, so post 105*a* or 105*b* may telescope over tube 402.

In this example post 401, which may be either round or square, has at least two holes 408 into which pins 407 are press fit and post 105*b* has bores 406 of a diameter to be a slip fit for pins 407. As assembled, posts 105*a* or 105*b*, bearing a weight, may compress spring 404 and telescope downward over pins 407. Pins 407 also restrain post 105*b* in horizontal rotation, so all posts 105*b* may remain aligned as shown in FIG. 1B. A lower limit to downward movement of post 105*a* or 105*b* is the upper end of post 401, so the limit dimension is $L_3$. Post 105*a* or 105*b* will assume an equilibrium position balancing the force on the post with the force of the spring.

FIG. 4 illustrates the assembly of elements for one post 105*a* or 105*b* of the 36 posts 105*a* or 105*b* in the resilient seat area in this example. Posts 105*a* or 105*b* will depress according to the force imposed on each by a person sitting on the resilient seat area.

Referring again to FIGS. 1A and 1B, posts 104*a* or 104*b*, 105*a* or 105*b* and 106*a* or 106*b* form the back and seat of a chair in an embodiment of the invention. However, additional elements may be added to provide a cushioned seat surface and to provide aesthetic enhancement.

Figure 5:
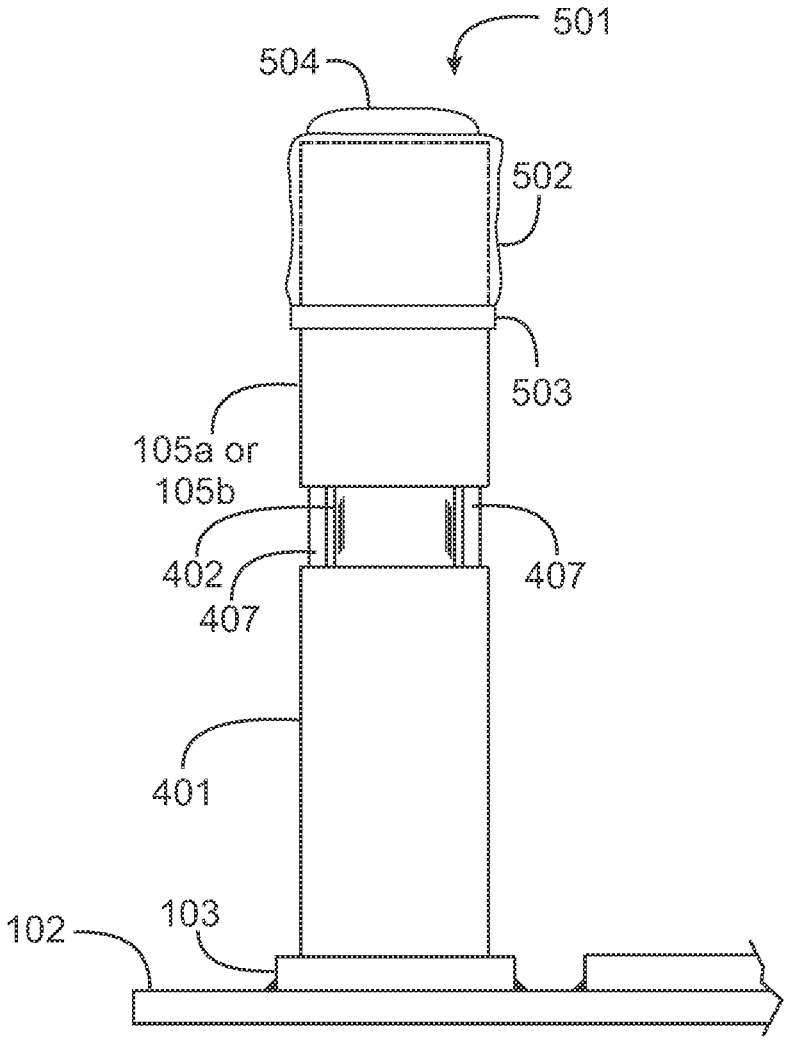
FIG. 5 is an elevation view of the post assembly of FIG. 4, but not in partial section as in FIG. 4.

FIG. 5 is an elevation view of the post assembly of FIG. 4, but not in partial section as in FIG. 4. A cushion sock 501 is provided to enable a removable, replaceable cushion at the upper end of each of posts 104*a* and 104*b* and of posts 105*a* and 105*b* that form the seat of the chair in this example. Cushion sock 501 comprises in this example a fabric skirt 502 sewn to fit over the round or square aspect of the posts, a cushion 504, which may be foam, or may be in some embodiments a hollow envelope filled with a cushioning material like ground foam, feathers and the like. A lower hem 503 may be included that may be elastic to help keep the cushion sock in place on the posts.

Cushion socks 501 may be provided in a variety of designs and colors, and may be periodically removed, cleaned and replaced or new cushion socks may be substituted. In alternative embodiments cushions may be provided at the upper ends of post by formed or molded plastic sockets having a square or a round opening a bit larger than the square or round dimensions of the posts, and cushions joined to the upper surface of the sockets. In another alternative cushions may be provided with hook and loop fasteners to join to the tops of the posts, or cushions may have an adhesive surface whereby they may be joined to the tops of posts and removed as well. There are many possibilities.

The skilled artisan will understand that the embodiments illustrated and described in this application are entirely exemplary and are not limiting to the scope of the invention. There are many alterations that may be made within the scope of the invention. For example, the upper ends of backrest posts 106*a* or 106*b* may be angled or beveled in some embodiments for aesthetic effect. Posts may be polished or painted in some embodiments. In some embodiment's alternate posts 106*a* or 106*b* may be painted different colors, and the same may be true for posts 104*a* or 104*b*. There are similarly a variety of ways that functionality may be provided for the resilient seating area. The scope of the invention is limited only by the claims.

The invention claimed is:

1. A chair, comprising: a metal base; a matrix of metal tubes having a common outside and an inside diameter, welded orthogonal to the metal base, extending vertically; and a matrix of posts matching the matrix of metal tubes, the posts bored for a portion of a length of each post, with each post engaged over one of the metal tubes; characterized in that one row of posts in the matrix of posts along one edge of the metal base comprises posts of a first height and forms a backrest for the chair, and in that a remaining matrix of posts of the matrix of posts, of a second height less than the posts forming the backrest, forms a seat surface of the chair, the remaining matrix of posts forming the seat surface of the chair are compound posts having an upper portion engaging the outside diameter of the tubes, the upper portion supported on a compression spring such that the upper portions of posts in the remaining matrix of posts provide a resilient surface for a subject seated on the chair and the upper portions supported by the compression springs are all in the remaining matrix of posts in positions other than a position forming an edge of the matrix.

2. The chair of claim 1 wherein the posts are round in cross section.

3. The chair of claim 1 wherein the compression springs are supported by a cylindrical insert within each of the metal tubes having the upper portions.

4. The chair of claim 1 wherein the metal base comprises an assembly of metal strips, comprising first metal strips parallel and equally spaced apart, and second metal strips laid at a right angle on the first metal strips, parallel and equally spaced apart, and wherein the metal tubes are welded in rows onto the second metal strips.

5. The chair of claim 1 further comprising cap structures over the upper portions of the posts forming the seat surface of the chair, the cap structures configured to fit over the posts removably and to provide a cushion surface on an upper end of the posts.

6. The chair of claim 5 wherein the cap structures are fabric structures comprising a skirt and a cushion.

7. The chair of claim 1 wherein the posts are square in cross section.

8. The chair of claim 7 wherein a portion of the remaining matrix of posts forming the seat surface of the chair are compound posts having an upper portion engaging the outside diameter of the tubes, the upper portion supported on a compression spring such that the upper portion of the compound posts provide a surface for a subject seated on the chair.

9. The chair of claim 8 wherein the upper portions of the posts are keyed to lower portions and the lower portions are keyed to the metal base, such that the posts are constrained from rotating on the metal tubes and from rotating relative to one another.

10. The chair of claim 8 wherein the post portions supported by compression springs are all in the matrix in positions other than a position forming an edge of the matrix.

11. The chair of claim 8 wherein the metal tubes welded to the base for the posts supported by compression springs have a cylindrical insert inside the tube supporting the compression spring.

12. The chair of claim 5 wherein the metal base comprises as assembly of metal strips, comprising first metal strips parallel and equally spaced apart, and second metal strips laid at a right angle on the first metal strips, parallel and equally spaced apart, and wherein the metal tubes are welded in rows onto the second metal strips.

13. The chair of claim 8 further comprising cap structures over the upper portions of the remaining matrix of posts forming the seat surface of the chair, the cap structures configured to fit over the posts removably and to provide a cushion surface on an upper end of the posts.

14. The chair of claim 13 wherein the cap structures are fabric structures comprising a skirt and a cushion.

* * * * *